United States Patent [19]

Hoppe

[11] 3,979,024

[45] Sept. 7, 1976

[54] INGREDIENT TEMPERATURE STABILIZATION APPARATUS FOR POST-MIX BEVERAGE DISPENSING MACHINES

[75] Inventor: William C. Hoppe, Kansas City, Mo.

[73] Assignee: The Vendo Company, Kansas City, Mo.

[22] Filed: Dec. 27, 1974

[21] Appl. No.: 536,821

[52] U.S. Cl. ..... 222/67; 222/129.1; 222/146 C; 62/396; 137/574

[51] Int. Cl.[2] ..... B67D 5/62

[58] Field of Search ..... 222/67, 129.1, 129.4, 222/146 C, 377; 137/574; 62/389, 396

[56] References Cited

UNITED STATES PATENTS

| | | | |
|---|---|---|---|
| 1,391,075 | 9/1921 | Phillippi | 137/574 X |
| 2,982,114 | 5/1961 | Cobb et al. | 222/146 C |
| 3,266,672 | 8/1966 | Dean | 222/129.1 |
| 3,347,421 | 10/1967 | Yingst et al. | 222/129.1 |
| 3,721,369 | 3/1973 | Conti | 222/67 |
| 3,731,845 | 5/1973 | Booth | 222/67 |

*Primary Examiner*—Stanley H. Tollberg
*Assistant Examiner*—Frederick R. Handren
*Attorney, Agent, or Firm*—Schmidt, Johnson, Hovey & Williams

[57] ABSTRACT

Improved liquid ingredient temperature control apparatus is provided for use with post-mix beverage vending machines which ensures that the beverage ingredients dispensed are maintained at desirable cool temperatures notwithstanding continual or intermittent supply replenishment of the ingredients with quantities thereof initially at ambient temperature. Removable, apertured tank partitions are employed for dividing the ingredient tanks into separate upper and lower zones in restricted partial communication so that any warm ingredients added to the upper zones thereof are prevented from freely admixing with the cool ingredients within the lower zones and thus raising the temperature of the latter. Liquid removal conduits in communication with the lower tank zones are operable to selectively draw volumes of cooled ingredients therefrom as required, thus permitting like volumes of the warm ingredients thereabove to migrate to the lower zones through the apertured tank partitions. In the preferred form, an open-top, water receiving overflow cup is provided for initially receiving water introduced into the upper zone of the water tank.

2 Claims, 4 Drawing Figures

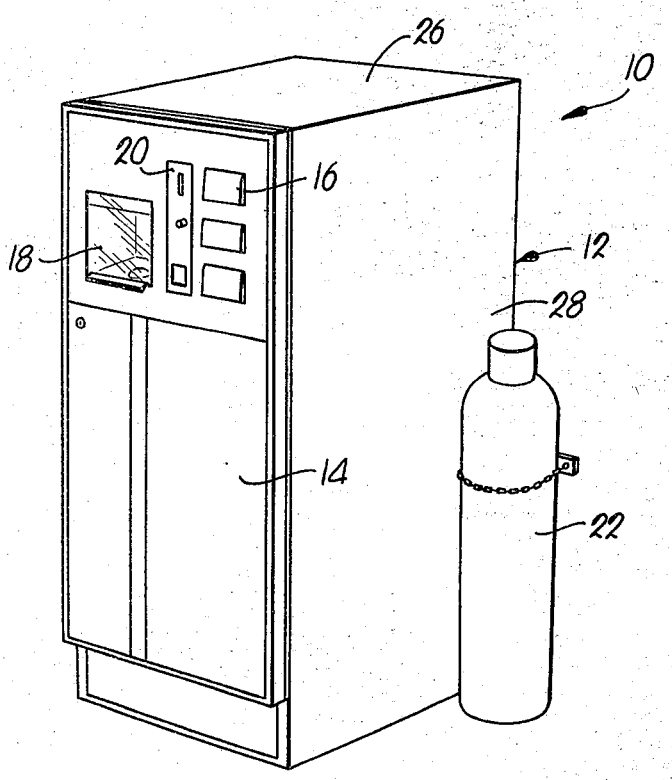
Fig. 1.
Fig. 3.
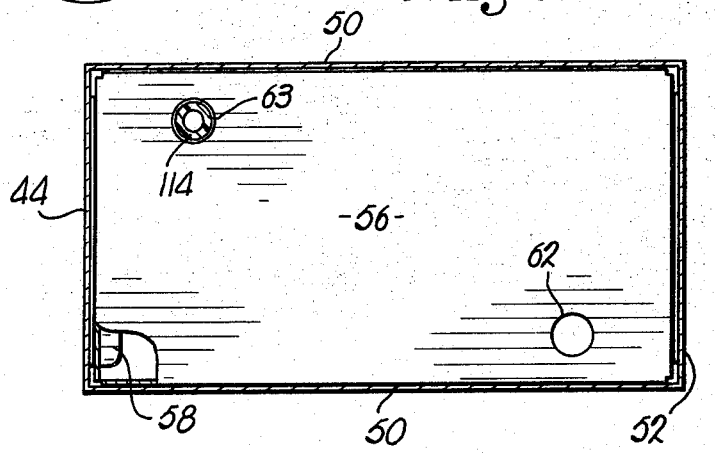
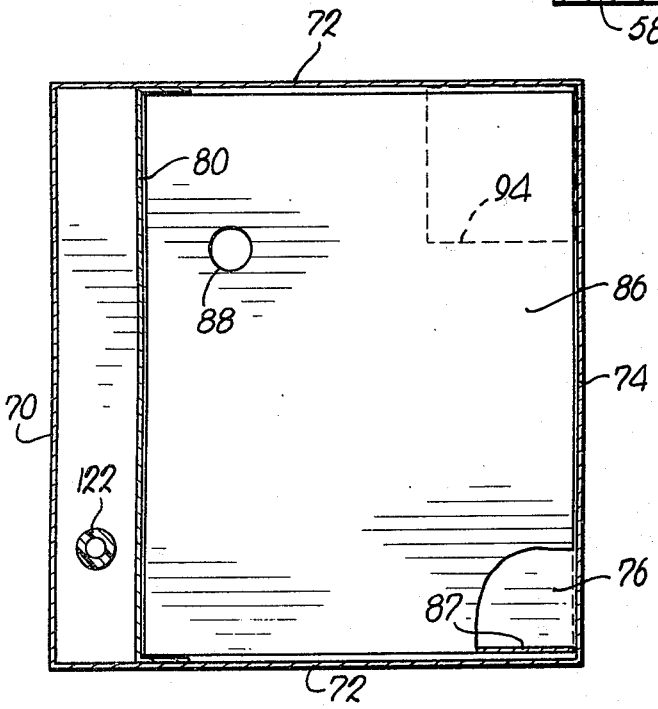
Fig. 4.

INGREDIENT TEMPERATURE STABILIZATION APPARATUS FOR POST-MIX BEVERAGE DISPENSING MACHINES

This invention relates to improved liquid ingredient temperature control apparatus for use with post-mix beverage vending machines. More particularly, it is concerned with such control apparatus especially adapted for use with relatively small post-mix machines not having an ice-making and dispensing mechanism as an adjunct thereof in order to ensure that cooled soft drinks or the like are dispensed at all times, even immediately after resupply of the liquid ingredients with initially warm quantities thereof.

Conventional post-mix beverage dispensing machines employ separate tanks for holding the ingredients of soft drinks or the like, along with apparatus for selectively delivering a required quantity of the separate ingredients to the mixing and dispensing stations of the machine. In the case of soft drinks for example, separate normally unrefrigerated syrup tanks are provided for each flavor, along with a relatively large refrigerated water tank having syrup and water lines immersed therein. In order to dispense a cool soft drink from such machines during peak draw periods, it is necessary to rapidly cool the separate quantities of syrup and water in their respective lines in order to ensure that the customer is not presented with a warm and unappetizing soft drink.

Such rapid capacity for cooling requires correspondingly large and expensive refrigeration components. Furthermore, it has become widely customary to equip such machines with ice dispensers to assure beverages of suitably low temperature, regardless of variations in ingredient temperatures, thus further adding to the complexity and cost of the system. While such conventional machines were well suited to high demand locations, they have proved too expensive and bulky for serving small offices or other commercial establishments having a relatively limited machine patronage. Consequently, the need has arisen for a greatly simplified post-mix system employing a refrigerated cabinet having containers for suitable supplies of each of the beverage ingredients, whereby the ingredients would at all times be maintained at adequately low temperatures for vending a palatable beverage without the need for dispensing ice along therewith. However, it has been found that too warm a drink would frequently result from the replenishment of syrups during ordinary servicing or during periods of peak draw because of the relatively high temperature of the incoming water.

It is therefore the most important object of the present invention to provide ingredient temperature stabilization apparatus for use in small and relatively inexpensive post-mix beverage dispensing machines having no ice dispensing facility which is operable to maintain and dispense the beverage ingredients at desirable temperatures even immediately after filling of the ingredient supply tanks with replenishment quantities of the ingredients which are initially at ambient temperatures.

As a corollary to the foregoing, it is an object of the invention to provide liquid ingredient temperature control apparatus comprising removable, apertured tank partitions for dividing the ingredient tanks into separate zones in restricted partial communication so that initially warm replenishment quantities of liquid ingredients added to the tanks are physically separated from the cooled ingredients therein, thereby precluding free intermixing of the respective quantities with consequent undesirable temperature increases in the cooled ingredients, in conjunction with ingredient removal apparatus communicating with the cooled volumes of the ingredients so that only cooled quantities thereof are dispensed.

A still further object of the invention is to provide liquid temperature control apparatus including an open-top overflow cup within the uppermost zone of an ingredient tank for receiving ingredient introduced into such tank for gentle overflow therefrom and consequent minimization of initial intermixing between the newly introduced warm ingredients and those already partially cooled within the tank.

In the drawings:

FIG. 1 is a perspective view of a post-mix beverage dispensing machine in accordance with the invention, shown with a tank of carbon dioxide positioned adjacent the same;

FIG. 3 is a sectional view taken along line 3—3 of FIG. 2 and illustrating one of the syrup supply tanks of the dispensing machine; and FIG. 4 is a sectional view taken along 4—4 of FIG. 2 and depicting the water tank of the dispensing machine, the overflow cup of the water tank being shown in phantom.

Figure 2:
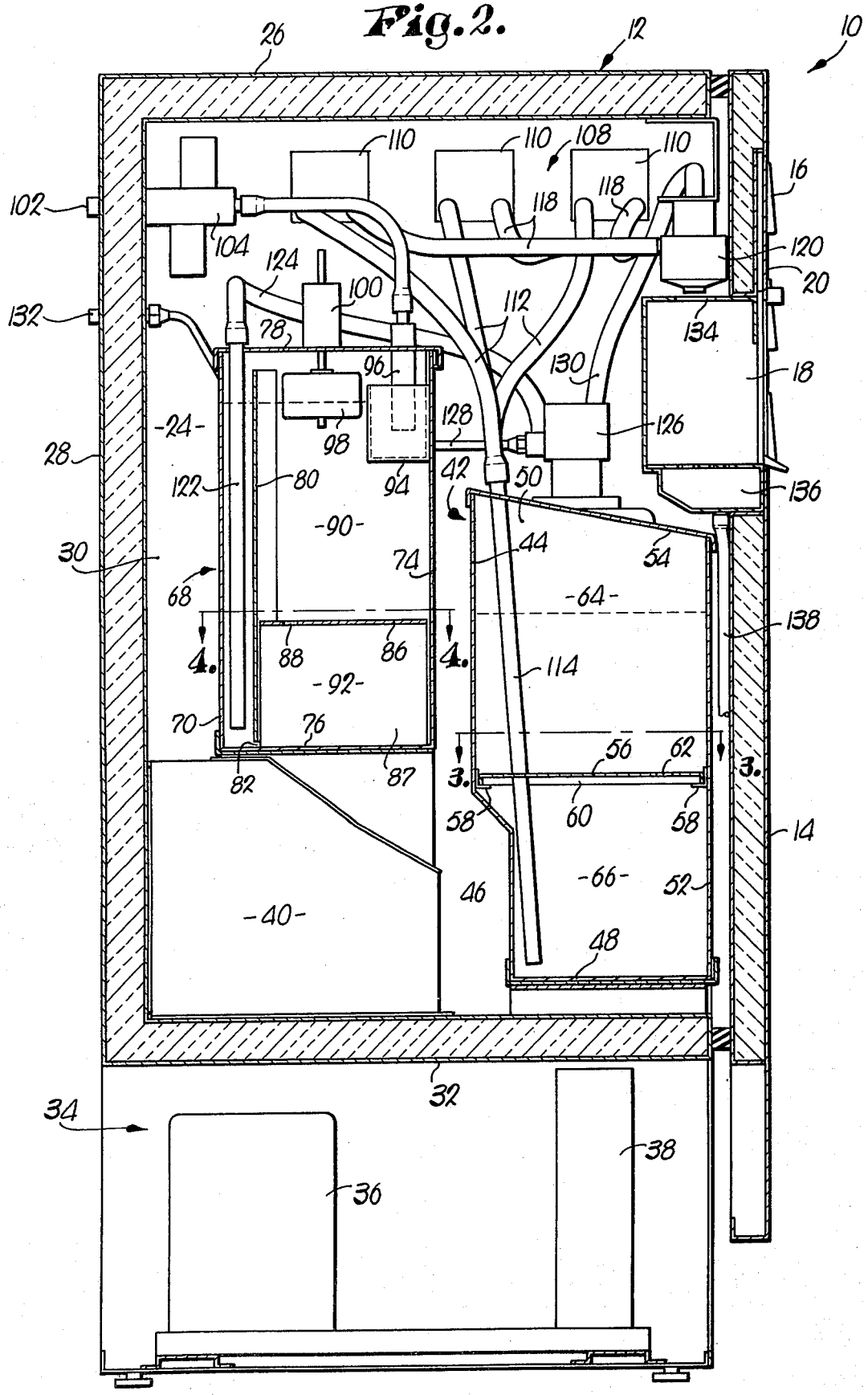
FIG. 2 is a vertical sectional view of the machine illustrated in FIG. 1 and depicting the internal operational apparatus thereof.

A post-mix beverage dispensing machine 10 for soft drinks or the like is illustrated in FIG. 1. Machine 10 broadly comprises an upright cabinet 12 having a hingedly openable forward door 14. A series of beverage selection panels 16 are provided in the upper section of door 14 along with a recessed beverage dispensing station 18 and conventional coin receiving and returning mechanism 20. In addition, an external cylinder 22 of carbon dioxide is provided for providing carbonation for the beverages dispensed from machine 10.

Referring specifically to FIG. 2, it will be seen that cabinet 12 includes a box-like, insulated upper chamber 24 defined by top wall 26, back wall 28, sidewalls 30 and bottom wall 32. The forward face of chamber 24 is covered by an insulated, hingedly mounted, side opening door 14. A refrigeration assembly 34 including a compressor 36 and condenser 38 is positioned beneath insulated bottom wall 32 and supported within the lowermost section of cabinet 12. A conventional evaporator 40 is positioned within insulated chamber 24 and is operatively connected with the remainder of refrigeration assembly 34 for the purpose of cooling the entire contents of the chamber 24.

A series of upright, juxtaposed syrup tanks 42 are provided within chamber 24 for the purpose of holding individual flavors of soft drink syrup. Each tank 42 includes an upright back wall 44 having a forwardly offset lowermost section 46, along with a bottom wall 48, spaced sidewalls 50 and a generally planar front wall 52 of lesser height than that of back wall 44. A removable, apertured cover 54 is also provided for the purpose of closing each tank 42.

A removable, apertured partition 56 is seated within each tank 42 and rests upon angles 58 affixed to the respective front and back walls of the tank. Each partition 56 includes a downturned circumscribing marginal lip 60 which rests atop the angles 58. In addition, spaced apertures 62 and 63 are provided in partition 56 which are important for purposes to be made clear hereinafter. It will be seen that partition 56 divides each tank 42 into an upper zone 64 and a lower zone 66, the two zones being in restricted partial communication by provision of aperture 62.

A single water supply tank 68 is positioned within chamber 24 substantially atop evaporator 40. Tank 68 includes an upright back wall 70, sidewalls 72, and front wall 74. A bottom wall 76 along with a removable apertured lid 78 are also provided for closing tank 58. An upright chamber-defining wall 80 is situated within tank 68 in spaced relationship from back wall 70. A water passageway 82 is also provided between the lowermost marginal edge of wall 80 and bottom wall 76.

Transversely U-shaped partition-defining structure is seated within tank 68 and includes an apertured, generally planar top wall 86 which extends forwardly between wall 80 and front wall 74 of tank 68, and laterally between the spaced sidewalls 72 thereof. A pair of marginal, depending sidewalls 87 extend from top wall 86 and support the latter within tank 68. Top wall 86 is also apertured as at 88 to provide restricted partial communication between the water receiving zone 90 of tank 68 and the cold water discharge zone 92 therebelow.

An open-top overflow cup 94 is positioned within tank 68 adjacent the upper end thereof for initially receiving water delivered thereto through pipe 96. Additionally, a float 98 is connected to an external lid-mounted collar 100 for the purpose of metering the liquid level within tank 68.

An external water conduit (not shown) is connected to fitting 102 on back wall 28 for the purpose of delivering fresh water to machine 10 as required. In this regard, a conventional solenoid valve 104 within chamber 24 is utilized for permitting selective volumes of water to flow through conduit 106 to pipe 96 for ultimate delivery to overflow cup 94 and thence to zone 90. Conventional electrical means is employed for operatively interconnecting float 98 and valve 104 in order that the requisite quantities of water are automatically delivered to tank 68 upon depletion thereof as sensed by float 98.

Ingredient utilization apparatus broadly designated by the numeral 108 is also provided within chamber 24 for the purpose of selectively drawing required amounts of syrup and water for dispensing in station 18. Structure 108 includes conventional, schematically represented syrup pumping and valving mechanism 110, with conduits 112 extending from each of the latter to the respective tanks 42 of soft drink syrup therebelow. An elongate syrup withdrawing pipe 114 is situated within each tank 42 and is attached at the uppermost end thereof to the corresponding line 112. Each pipe 114 extends completely through the corresponding upper zone 64 within each tank 42 and through the adjacent partition aperture 63 provided therefor to terminate within zone 66 therebelow. In addition, each syrup pumping and valving mechanism 110 includes a delivery conduit 118 which extends to mixing apparatus 120 positioned above dispensing station 18.

Similarly, an elongate water withdrawing pipe 122 is positioned within the relatively narrow upright chamber defined between back wall 70 and wall 80 of tank 68. A delivery conduit 124 is interconnected between the uppermost end of pipe 122 and a conventional carbonator 126 so that the water from tank 68 can be carbonated prior to mixing and dispensing thereof with the appropriate soft drink syrup. In this regard, an elongate carbon dioxide conduit 128 extends from carbonator 126 to back wall 28 of machine 10 and is in communication with external fitting 132. A second conduit (now shown) interconnects fitting 132 and a tank of carbon dioxide 22. Finally, a carbonated water delivery conduit 130 extends between carbonator 126 and mixing apparatus 120 to permit delivery of carbonated water to the latter.

In use, when the customer deposits the required coinage within mechanism 20, machine 10 is actuated to withdraw the requisite amount of syrup and water (after carbonation thereof) for mixing in apparatus 120. Upon mixing therein, the post-mixed soft drink is dispensed through opening 134 in the top wall of recessed dispensing station 18, the latter being configured to receive an upright beverage-receiving container or cup. Any overflow of the dispensed beverage is collected within sink 136 and discarded through drain pipe 138 in the well known manner.

In the normal operation of machine 10, it will be appreciated that the entire contents of chamber 24 are cooled by means of refrigeration apparatus 34. Thus, during such normal use only cooled volumes of syrup and water will be within the respective tanks, thereby assuring that only properly cooled soft drinks will be dispensed.

However, when the supply of syrup within the tanks 42 become depleted to a point requiring replenishment thereof, the liquid temperature stablization apparatus of the present invention is operable to ensure that users of machine 10 will not be presented with an unappetizing warm drink, even immediately after servicing of the machine. By way of illustration, should a syrup tank 42 need refilling, door 14 can be swung open and top 54 of tank 42 removed. At this point the serviceman simply pours warm fresh syrup into tank 42 through the open top thereof until a desired liquid level is reached. By virtue of the use of apertured partition 56 and elongate pipe 114 extending below the latter, it is clear that such initially warm quantities of syrup will not be immediately dispensed but rather will be physically separated from the cooled contents of lowermost zone 66. As incremental quantities of syrup are withdrawn from zone 66, like volumes of the warm or partially cooled syrup within zone 64 migrate through opening 62 into lowermost zone 66. However, since the two zones are in only restricted partial communication, it will be apparent that such minor admixing will not appreciably raise the temperature of the syrup to be dispensed.

Similarly, the apparatus of the present invention is operable to ensure that the water for the soft drinks is adequately cooled prior to dispensing thereof. In this case, water is continually or intermittently added to tank 68 as needed through the use of the float and solenoid valve structure described. In addition, open-top overflow cup 94 is provided beneath delivery pipe 96 for minimizing agitation from intermixing of newly introduced quantities of water within tank 68 and those quantities partially or fully cooled therewithin. Also, as quantities of water are withdrawn from tank 68 through pipe 122, like volumes thereof from zone 90 flow through aperture 88 and into lower zone 92 whereupon similar quantities flow from the latter through passageway 82 to the zone between back wall 70 and wall 80 of tank 68.

It will thus be seen that the apparatus of the present invention provides a simplified means for ensuring that dispensed quantities of beverage ingredients are maintained at a desirable cold temperature notwithstanding continual or intermittent resupply of the ingredients. Accordingly, the invention is believed to represent a novel advance in the art of beverage vending machines, and especially with respect to small, simplified vending machines not having an ice-making and dispensing function which must totally rely upon precooling of the liquids to be dispensed.

Having thus described the invention, what is claimed as new and desired to be secured by Letters Patent is:

1. In a post-mix beverage dispensing machine:

a cabinet having a chamber therein;

means for refrigerating said chamber;

means within said chamber for utilizing a liquid ingredient in preparing a beverage to be dispensed;

an ingredient container within said chamber;

generally horizontally extending partition means within said container dividing the interior of said container into separated upper and lower zones, said partition means being provided with an opening placing the bottom of said upper zone in restricted liquid communication with the top of said lower zone;

means for permitting introduction from time to time of supply-replenishing quantities of a liquid beverage ingredient at substantially ambient temperature into said upper zone of said container, said introduction means including an open-top overflow cup within said upper zone of said container adjacent the top thereof, into which cup said quantities of said ingredient may be initially introduced for relatively gentle overflow therefrom into the remainder of said upper zone for minimizing agitation in connection with intermixing of said newly introduced quantities with quantities of cooler ingredient already within said upper zone;

means coupled with said ingredient utilization means and communicating with said lower zone adjacent the bottom thereof for removing from said lower zone amounts of said ingredient as required for the preparation of beverages to be dispensed, whereby said quantities of said ingredient initially introduced into said cup at ambient temperature are gently delivered to said container and are cooled during storage and migration thereof from said upper zone to said lower zone as said amounts of already cooled ingredient are removed as required from said lower zone.

2. The invention as set forth in claim 1, wherein is provided means for automatically controlling the introduction of said quantities of ingredient into said container to maintain the upper level of said ingredient within said upper zone near the level of the open-top of said cup for maximizing the tendency of warmer newly introduced ingredient to remain on top of cooler quantities of ingredient already within said upper zone.

* * * * *